US007767472B2

(12) United States Patent
Shigeta et al.

(10) Patent No.: US 7,767,472 B2
(45) Date of Patent: Aug. 3, 2010

(54) SUBSTRATE PROCESSING METHOD AND SUBSTRATE PROCESSING APPARATUS

(75) Inventors: Atsushi Shigeta, Fujisawa (JP); Gen Toyota, Oita (JP); Hiroyuki Yano, Yokohama (JP); Kunio Oishi, Tokyo (JP); Kenya Ito, Tokyo (JP); Masayuki Nakanishi, Tokyo (JP); Kenji Yamaguchi, Tokyo (JP)

(73) Assignees: Ebara Corporation, Tokyo (JP); Kabushiki Kaisha Toshiba, Tokyo (JP)

( * ) Notice: Subject to any disclaimer, the term of this patent is extended or adjusted under 35 U.S.C. 154(b) by 246 days.

(21) Appl. No.: 11/882,398

(22) Filed: Aug. 1, 2007

(65) Prior Publication Data

US 2007/0287364 A1 Dec. 13, 2007

Related U.S. Application Data

(63) Continuation of application No. 11/187,024, filed on Jul. 22, 2005, now abandoned.

(30) Foreign Application Priority Data

Jul. 26, 2004 (JP) ..... 2004-217572

(51) Int. Cl.
*H01L 21/00* (2006.01)

(52) U.S. Cl. ..... 438/5; 438/10; 438/692; 257/E21.304; 257/E21.306

(58) Field of Classification Search ..... 257/E21.079, 257/E21.304, E21.306; 438/5, 10, 692
See application file for complete search history.

(56) References Cited

U.S. PATENT DOCUMENTS 3,274,736 A 9/1966 Roscoe
4,375,141 A 3/1983 Gaetano
5,069,002 A 12/1991 Sandhu et al.
5,597,341 A 1/1997 Kodera et al.
5,643,060 A 7/1997 Sandhu et al.
5,762,537 A 6/1998 Sandhu et al.
5,783,470 A 7/1998 Rostoker
5,899,792 A 5/1999 Yagi
5,904,608 A 5/1999 Watanabe
6,336,851 B1 1/2002 Shendon
6,340,434 B1 1/2002 Mizuno et al.
6,342,166 B1 1/2002 Ide et al.
6,458,014 B1 10/2002 Ishikawa et al.
6,494,765 B2 12/2002 Gitis et al.
6,561,871 B1 5/2003 Sommer (Continued)

FOREIGN PATENT DOCUMENTS

JP 2004-241434 4/2004

*Primary Examiner*—Jarrett J Stark
(74) *Attorney, Agent, or Firm*—Wenderoth, Lind & Ponack, L.L.P.

(57) ABSTRACT

A substrate processing method is used to polish a substrate. The substrate processing method includes rotating a substrate 13 by a motor 12, polishing a first surface of a peripheral portion of the substrate 13 by pressing a polishing surface of a polishing mechanism 20 against the first surface, determining a polishing end point of the first surface by monitoring a polished state of the first surface, stopping the polishing according to the determining the polishing end point, determining a polishing time spent for the polishing, determining a polishing time for a second surface of the peripheral portion based on the polishing time of the first surface, and polishing the second surface for the determined polishing time.

14 Claims, 6 Drawing Sheets

U.S. PATENT DOCUMENTS 6,561,873 B2 5/2003 Tsai et al.
6,568,989 B1 5/2003 Molnar
6,749,714 B1 6/2004 Ishikawa et al.
6,910,944 B2 6/2005 Birang et al.
6,986,698 B1 1/2006 Molnar
7,040,954 B1 5/2006 McClatchie et al.
2002/0037681 A1 3/2002 Gitis et al.
2002/0090889 A1 7/2002 Crevasse et al.
2002/0127951 A1 9/2002 Ishikawa et al.
2004/0102141 A1 5/2004 Swisher et al.
2004/0106363 A1 6/2004 Ishii et al.
2004/0152316 A1 8/2004 Ono et al.
2004/0185751 A1 9/2004 Nakanishi et al.
2004/0261944 A1 12/2004 Wakabayashi et al.
2005/0032462 A1 2/2005 Gagliardi et al.
2005/0075052 A1 4/2005 Kim et al.
2005/0112998 A1 5/2005 Matsuo et al.
2005/0186691 A1 8/2005 Koike et al.
2005/0250331 A1 11/2005 Arai et al.
2005/0272348 A1 12/2005 Min et al.
2006/0030244 A1 2/2006 Talieh
2006/0109591 A1 5/2006 Ranjan et al.
2006/0135042 A1 6/2006 Frost et al.

SUBSTRATE PROCESSING METHOD AND SUBSTRATE PROCESSING APPARATUS

This is a continuation of U.S. patent application Ser. No. 11/187,024, filed Jul. 22, 2005 now abandoned.

BACKGROUND OF THE INVENTION

1. Field of the Invention

The present invention relates to a substrate processing method and a substrate processing apparatus, and more particularly to a substrate processing method and a substrate processing apparatus for polishing a peripheral portion of a substrate to remove an unwanted film and planarize an uneven surface.

2. Description of the Related Art

In a large scale integrated circuit, various kinds of micromachining techniques have recently been studied and developed. In the design rule, micromachining on a submicron order has already been realized. As the need for a finer structure has become more severe, management of particles and impurity concentration has also become strict. In addition, it has been increasingly important to manage a peripheral portion as well as front and rear surfaces of a substrate. Under such circumstances, an etching technique using a chemical liquid and a polishing technique of removing an unwanted film from a substrate have been applied to a method of processing a peripheral portion of a substrate. Particularly, the polishing technique is excellent in removing a high chemical resistant material and in planarizing an uneven surface, and is therefore widely used in various kinds of processes.

This kind of polishing technique removes a film on a substrate by bringing a polishing surface of a polishing tool into sliding contact with the substrate at a certain pressure. As disclosed in Japanese laid-open patent publication No. 2003-234314, there are two types in this kind of polishing method: one is conducted while supplying polishing liquid, i.e., slurry, containing abrasive particles onto a contact portion between a substrate and a polishing surface of a polishing cloth such as a nonwoven fabric, and the other is conducted while supplying pure water onto a contact portion between a substrate and a polishing surface of a polishing tape having abrasive particles fixed thereto.

However, there are some problems in these polishing methods when polishing the peripheral portion of the substrate. Generally, a film on a peripheral portion of a substrate is not uniform in thickness, and the surface of the peripheral portion has irregularities with different heights. Further, the abrasive particles are not uniformly distributed over the peripheral portion, and the polishing cloth does not have a uniform structure. Thus, if polishing is performed in a fixed period of time, the surface of the peripheral portion cannot be uniformly finished. Specifically, the film, to be polished, may remain on the peripheral portion and the uneven surface may not be sufficiently planarized due to a lack of polishing, or a profile of the peripheral portion may change due to excessive polishing.

In a practical apparatus, a peripheral portion of a semiconductor substrate is polished as follows. A semiconductor substrate is attracted and held by a rotating stage and then the rotating stage is rotated. A polishing surface, which is attached to a polishing head, is brought into contact with the peripheral portion of the semiconductor substrate and presses the peripheral portion while pure water or a polishing liquid is being supplied onto the semiconductor surface, thereby polishing the peripheral portion. In this kind of apparatus, the semiconductor substrate is placed onto the center of the rotating stage by a transfer system such as a transfer robot. However, the semiconductor substrate may deviate from the center of the rotating stage due to several causes such as an error in repetitive operation of the transfer system, an abnormal operation of the transfer system, and an anomaly in a substrate holding mechanism during polishing.

The deviation from the center of the rotating stage causes instability in contact between the polishing tape and the substrate, and also causes instability in pressure applied to the substrate. As a result, a finished state of the peripheral portion is uneven, and, in the worst case, the substrate may crack during polishing. Therefore, it is necessary to grasp a degree of the anomaly in polishing so as to take appropriate measures.

SUMMARY OF THE INVENTION

The present invention has been made in view of the above drawbacks. It is therefore an object of the present invention to provide a substrate processing method and a substrate processing apparatus which can polish a peripheral portion of a substrate without causing a lack of polishing or excessive polishing.

Another object of the present invention is to provide a substrate processing method and a substrate processing apparatus which can detect an anomaly in polishing of a peripheral portion of a substrate and can thus prevent an uneven finish and substrate cracking.

In order to solve the above drawbacks, according to one aspect of the present invention, there is provided a substrate processing method comprising rotating a substrate by a motor, polishing a first surface of a peripheral portion of the substrate by pressing a polishing surface of a polishing mechanism against the first surface, determining a polishing end point of the first surface by monitoring a polished state of the first surface, stopping the polishing according to the determining the polishing end point, determining a polishing time spent for the polishing, determining a polishing time for a second surface of the peripheral portion based on the polishing time of the first surface, and polishing the second surface for the determined polishing time.

According to another aspect of the present invention, there is provided a substrate processing method comprising rotating the substrate by a motor, polishing the peripheral portion of the substrate by pressing a polishing surface of a polishing mechanism against the peripheral portion, monitoring a load of the motor, measuring an average load per unit time of the motor and a load fluctuation magnitude with respect to the average load, comparing the load fluctuation magnitude with a threshold, and determining an occurrence of an anomaly in the polishing when the load fluctuation magnitude exceeds the threshold.

According to another aspect of the present invention, there is provided a substrate processing method comprising rotating a substrate by a motor, polishing a peripheral portion of the substrate by pressing a polishing surface of a polishing mechanism against the peripheral portion, monitoring a load of the motor, measuring an average load per unit time of the motor and a load fluctuation magnitude with respect to the average load, detecting a load changing point at which the average load exceeds a predetermined value, and determining a polishing end time of the peripheral portion based on the load changing point and the load fluctuation magnitude.

According to another aspect of the present invention, there is provided a substrate processing apparatus comprising a motor for rotating a substrate, a polishing mechanism for polishing a first surface of a peripheral portion of the substrate by pressing a polishing surface of the polishing mechanism against the first surface, and an arithmetic unit for calculating a polishing time of the peripheral portion. The arithmetic unit is designed to determine a polishing end point of the first surface by monitoring a polished state of the first surface, determining a polishing time spent in polishing the first surface, and determine a polishing time for a second surface of the peripheral portion based on the polishing time of the first surface.

According to the present invention described above, the polishing end point of the first surface of the peripheral portion is firstly determined, and then the polishing time of the second surface is determined according to the polishing time of the first surface. With this method, the second surface as well as the first surface can be accurately polished by an appropriate amount. Therefore, it is possible to prevent the unwanted film and the irregularities from remaining on the substrate due to a lack of polishing, and also to prevent a profile of the peripheral portion from changing due to excessive polishing. Accordingly, a desired profile of the peripheral portion of the substrate can be realized.

Further, according to the present invention, the anomaly in polishing can be detected by monitoring the load of the motor during polishing and by measuring the load fluctuation magnitude with respect to the average load of the motor. Accordingly, it is possible to prevent an uneven finish of the peripheral portion and the substrate cracking due to deviation of the substrate from the center of the rotating stage.

Furthermore, according to the present invention, the polishing end time is determined based on the load changing point and the load fluctuation magnitude. With this method, polishing can be performed in a manner that gives consideration to nonuniform film thickness, irregularities with different heights, unevenly distributed abrasive particles, and a nonuniform structure of a polishing cloth. It is therefore possible to prevent the unwanted film and the irregularities from remaining on the substrate due to a lack of polishing, and also to prevent a profile of the peripheral portion from changing due to excessive polishing. Accordingly, a desired profile of the peripheral portion of the substrate can be realized.

DETAILED DESCRIPTION OF THE PREFERRED EMBODIMENTS

Embodiments of the present invention will be described below with reference to the drawings.

First Embodiment

Figure 1:
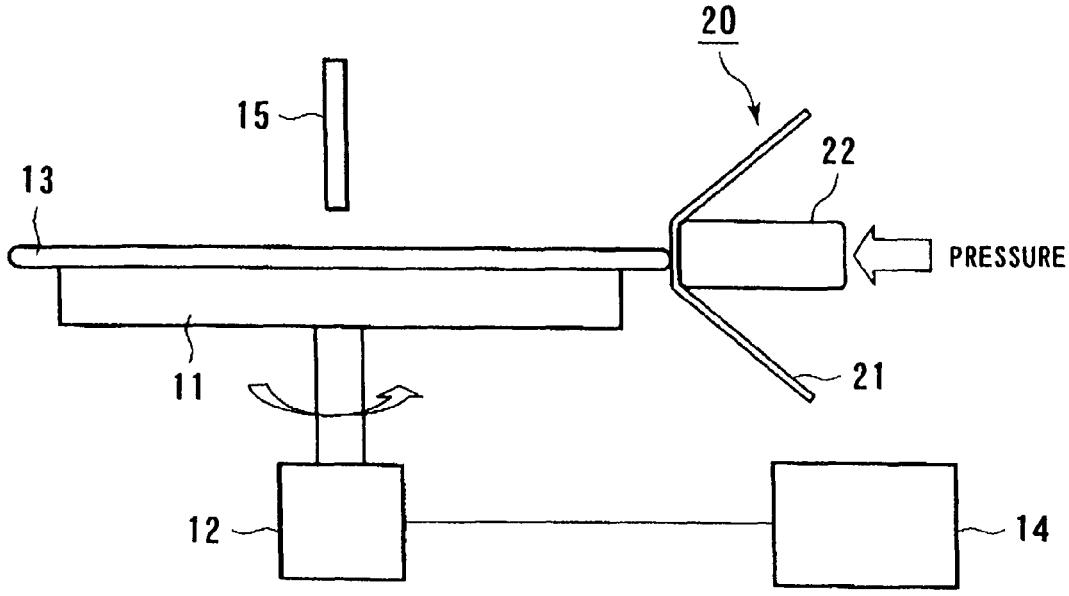
FIG. 1 is a schematic view showing a substrate processing apparatus used in a first embodiment of the present invention.

FIG. 1 shows a schematic view of a substrate processing apparatus used in a first embodiment of the present invention. The substrate processing apparatus comprises a disk-shaped rotating stage 11 disposed horizontally. The rotating stage 11 is rotated about its own axis by a motor 12. A semiconductor substrate 13, which has a larger diameter than the rotating stage 11, is placed on the rotating stage 11 in such a state that the center of the semiconductor substrate 13 is aligned with the center of the rotating stage 11. The semiconductor substrate 13 is held on the rotating stage 11 by a substrate holding mechanism such as an electrostatic chuck or a vacuum chuck. The load of the motor 12 is detected by a torque sensor or the like, and is calculated by an arithmetic unit 14. In this embodiment, a single ammeter is used to monitor a change in electric current flowing into the motor 12 to thereby detect a change in the load of the motor 12. In this case, by filtering slight deflection and noise of the electric current, an overall change of the electric current flowing into the motor 12 can be monitored. A nozzle 15 is provided above the center of the rotating stage 11 so that pure water is supplied onto an upper surface (i.e., a front surface) of the semiconductor substrate 13.

A polishing mechanism 20 is provided radially outwardly of the rotating stage 11 at a position close to the semiconductor substrate 13. The polishing mechanism 20 comprises a polishing head 22, a polishing tape 21 to which abrasive particles are fixed, and a pressure cylinder (not shown) for moving the polishing head 22 toward the rotating stage 11. The polishing tape 21 is in contact with a stage-side portion of the polishing head 22, and is moved vertically in a longitudinal direction thereof by a non-illustrated winding reel. When the semiconductor substrate 13 is to be polished, the pressure cylinder moves the polishing head 22 toward the semiconductor substrate 13 to press the polishing tape 21 against a peripheral portion of the semiconductor substrate 13. The pure water is supplied from the nozzle 15 onto the surface of the semiconductor substrate 13, and the motor 12 rotates the semiconductor substrate 13 attracted to the rotating stage 11 at a predetermined rotational speed.

In the above-mentioned substrate processing apparatus, the semiconductor substrate 13 is concentrically positioned on the rotating stage 11 by a non-illustrated transfer robot. After being polished, the semiconductor substrate 13 is removed from the substrate processing apparatus by the transfer robot.

Figure 2A:
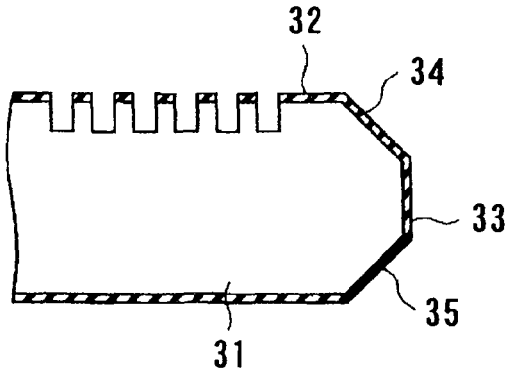
FIGS. 2A and 2B are cross-sectional views each showing a peripheral portion of a semiconductor substrate.

FIG. 2A is a cross-sectional view showing the peripheral portion of the semiconductor substrate 13 before being polished. In FIG. 2A, a reference numeral 31 represents a Si substrate, a reference numeral 32 represents a SiN film, a reference numeral 33 represents an end surface (a first surface) substantially perpendicular to the front surface of the Si substrate 31, a reference numeral 34 represents an upper sloping surface, and a reference numeral 35 represents a lower sloping surface. Both the upper sloping surface 34 and the lower sloping surface 35 constitute a second surface. The SiN film 32 on the peripheral portion of the Si substrate 31 is an object to be polished.

Figure 2B:
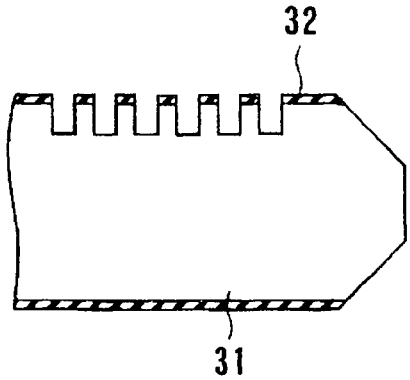

FIG. 2B is a cross-sectional view showing the peripheral portion of the semiconductor substrate 13 which has been polished by the substrate processing apparatus shown in FIG. 1. FIG. 2B also shows the peripheral portion at a polishing end point polished by the polishing tape 21 with diamond abrasive particles having a grain size of #4000. As shown in FIG. 2B, the SiN film 32 is removed from the peripheral portion of the Si substrate 31.

Figure 3:
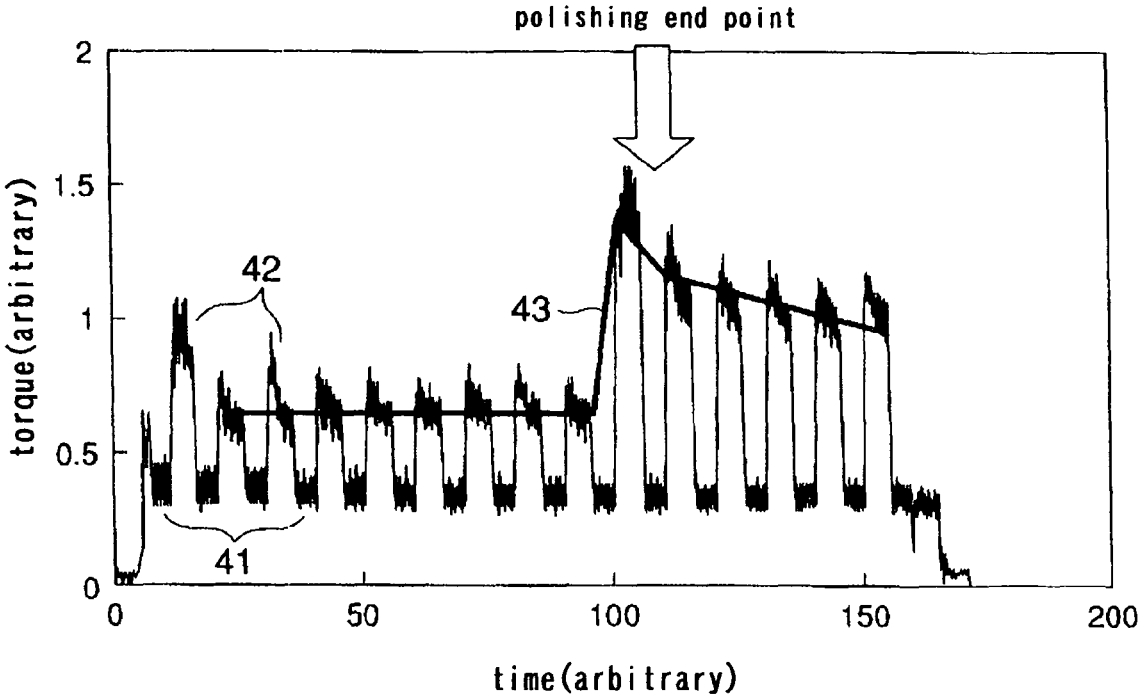
FIG. 3 is a graph showing a manner in which a load signal (torque) of a motor changes with the passage of time.

FIG. 3 shows a manner in which a load signal (torque) of the motor 12 changes with the passage of time during polishing of the peripheral portion of the semiconductor substrate 13. In this embodiment, the polishing tape 21 is repetitively brought into and out of contact with the peripheral portion at predetermined time intervals. Each time the polishing tape 21 is out of contact, the polishing tape 21 is slightly moved in the longitudinal direction thereof. The polishing tape 21 is pressed against the end surface (first surface) 33 of the substrate by the polishing head 22. In FIG. 3, a reference numeral 41 refers to graph points showing a state in which the polishing tape 21 is out of contact, a reference numeral 42 refers to graph points showing a state in which the polishing tape 21 is in contact, and a reference numeral 43 shows an average load per unit time of the motor during polishing.

As polishing proceeds, the unwanted film is removed and the uneven surface is planarized. Specifically, as shown in FIG. 3, after a certain time has elapsed from a start of polishing, the average load 43 of the motor 12 becomes stable. Near the polishing end point, the average load 43 increases suddenly, and after the polishing end point, the average load 43 becomes stable again. Therefore, in theory, a polishing end time can be determined based on a great changing point of the average load 43.

However, the peripheral portion of the semiconductor substrate has the end surface (vertical surface) 33 and the sloping surfaces 34 and 35, as shown in FIG. 2A. Thus, when polishing the surface other than the end surface 33, a contact area between the polishing surface of the polishing tape 21 and the semiconductor substrate 13 changes as polishing proceeds. Therefore, it is difficult to determine the polishing end time of all surfaces of the peripheral portion from the change in the average load of the motor 12.

In this embodiment, in order to accurately determine the polishing end time of the entire peripheral portion, the polished state is monitored based on the average load of the motor 12. Specifically, the average load of the motor 12 is used to determine the polishing end point of the end surface 33, and a polishing time spent in polishing the end surface 33 is determined from the polishing end point. Then, a polishing time for the upper sloping surface 34 and the lower sloping surface 35 is determined based on the polishing time of the end surface 33, a profile of the semiconductor substrate 13, and information about the thickness of the film that is to be removed. For example, the polishing time of the upper sloping surface 34 and the lower sloping surface 35 is set equal to the polishing time of the end surface 33, or is set to about 1.5 times the polishing time of the end surface 33. Typically, the polishing time of the upper sloping surface 34 and the lower sloping surface 35 is set to 1.1 to 2.5 times, or preferably 1.3 to 2.0 times the polishing time of the end surface 33. Depending on the material of the substrate, the polishing time of the upper sloping surface 34 and the lower sloping surface 35 may have to be shorter than the polishing time of the end surface 33. In such a case, the above-mentioned value is set to less than 1.0 times according to the material of the substrate. In a case where a substrate has a rounded cross section unlike the shape illustrated in FIG. 2A, "end surface" means a top portion of such a rounded cross section of the substrate.

Figure 4:
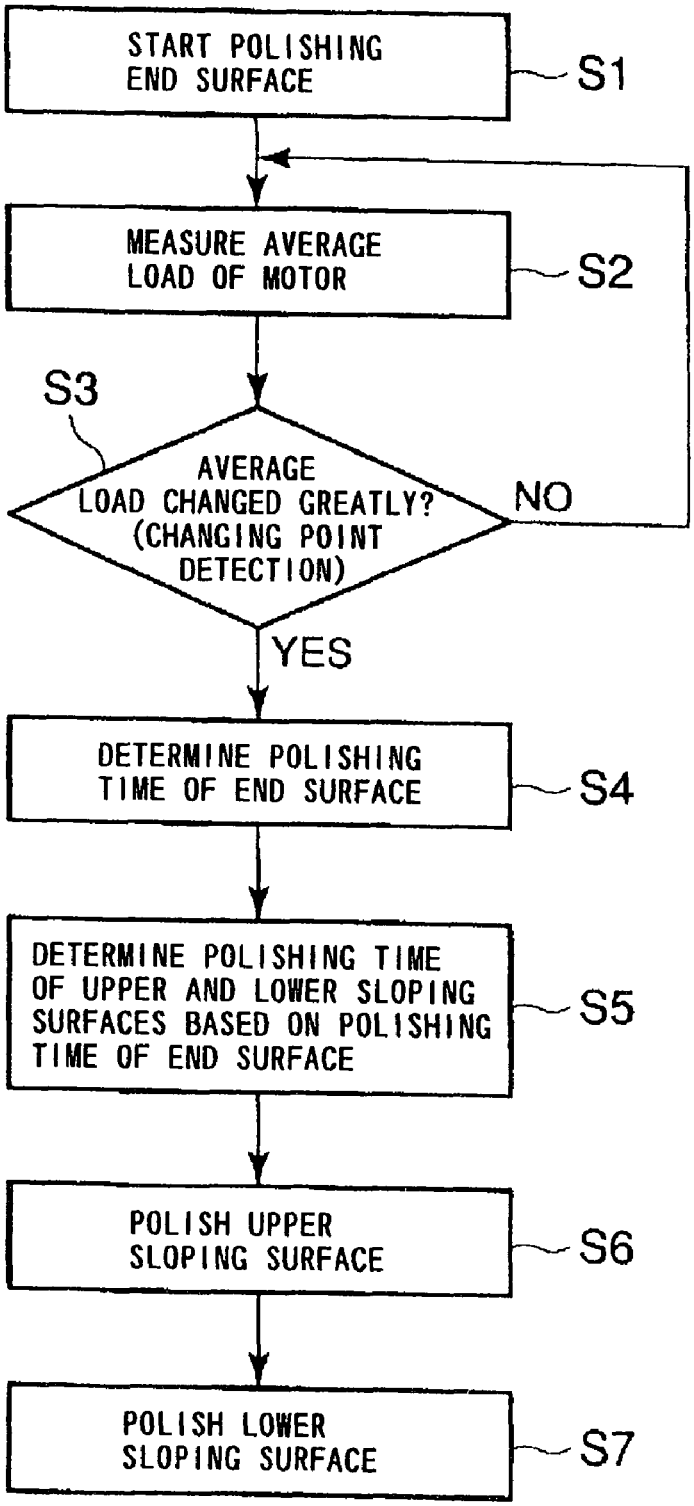
FIG. 4 is a flowchart illustrating a polishing operation according to the first embodiment of the present invention.

FIG. 4 is a flowchart illustrating a polishing operation according to the first embodiment of the present invention.

First, the rotating stage 11 attracts the semiconductor substrate 13 and is rotated by the motor 12 at a constant speed. Then, the polishing head 22 is moved toward the semiconductor substrate 13 to bring the polishing tape 21 into contact with the end surface 33 of the peripheral portion of the semiconductor substrate 13. The polishing tape 21 is pressed against the end surface 33 at a certain pressure to thereby start polishing the end surface 33 (STEP 1). The polishing tape 21 is repetitively brought into and out of contact with the semiconductor substrate 13 at intervals of, for example, 5 seconds. When in contact, the polishing tape 21 polishes the semiconductor substrate 13, and when out of contact, the polishing tape 21 is moved vertically. In this manner, the polishing mechanism 20 polishes the peripheral portion of the semiconductor substrate 13 by bringing the polishing surface into contact with the peripheral portion. When the semiconductor substrate 13 is being polished, the load signal of the motor 12 is monitored continuously or intermittently, and the average load is measured (STEP 2).

The arithmetic unit 14 judges whether or not the average load changed greatly (STEP 3). Specifically, the arithmetic unit 14 judges whether or not the average load exceeded a predetermined value. If the average load does not exceed the predetermined value, polishing is continued. If the average load has increased to exceed the predetermined value, the arithmetic unit 14 determines this point as the polishing end point, and then polishing is stopped. At this time, the arithmetic unit 14 determines the polishing time spent in polishing the end surface 33 (STEP 4).

The great change in the average load indicates that, for example, the SiN film 32 has been removed and the Si substrate 31 underneath exposed on the surface. However, at this point, a part of the SiN film 32 may remain on the Si substrate 31, and therefore such point may not be appropriate as the polishing end point. Thus, in order to accurately judge the polishing end point, it is preferable to select a point at which a predetermined time has elapsed from a point at which the average load increased greatly, or to select a point at which the average load is stabilized after it increased greatly. For example, the polishing end time can be a point at which 0 to 60 seconds, or preferably 0 to 30 seconds, have elapsed from a load changing point at which the average load exceeds the predetermined value.

Next, the polishing time of the upper sloping surface 34 and the lower sloping surface 35 is determined based on the polishing time of the end surface 33 (STEP 5). As described above, the polishing time of the upper sloping surface 34 and the lower sloping surface 35 is set equal to the polishing time of the end surface 33, for example. The polishing head 22 is inclined along the upper sloping surface 34, and then polishes the upper sloping surface 34 for the determined polishing time (STEP 6). Subsequently, the polishing head 22 is inclined along the lower sloping surface 35, and then polishes the lower sloping surface 35 for the determined polishing time (STEP 7). Thereafter, in order to further planarize the peripheral portion of the semiconductor substrate 13, the polishing mechanism 20 may be moved along the entire peripheral portion for a certain time to polish the peripheral portion.

In this manner, based on the profile of the peripheral portion of the semiconductor substrate 13, three-surface polishing (i.e., upper sloping surface polishing, end surface polishing, and lower sloping surface polishing) is performed by the polishing head 22, which is fixed in position at the surface to be polished. In this three-surface polishing, the upper and lower sloping surfaces are polished for a certain time which was determined based on the polishing time of the end surface. Finally, the polishing mechanism 20 is moved along the entire peripheral portion so as to polish the peripheral portion. According to such a polishing sequence, the SiN film 32 can be completely removed from the peripheral portion of the semiconductor substrate without greatly changing the original profile of the peripheral portion. Specifically, the method and the apparatus of this embodiment do not cause insufficient polishing or excessive polishing, and can thus polish the peripheral portion by an appropriate amount.

Generally, after three-surface polishing (i.e., upper sloping surface polishing, end surface polishing, and lower sloping surface polishing) is performed, angular portions are formed on the peripheral portion of the semiconductor substrate, as shown in FIG. 2B. If these angular portions are sharp, a part of the semiconductor substrate is likely to be chipped. Therefore, it is preferable that the polishing head 22 with the polishing tape 21 is moved along the entire peripheral portion so as to remove such angular portions.

Although the polishing time for the surface other than the end surface 33 is determined based on the polishing time of the end surface 33 in this embodiment, a surface to be selected as a reference of the polishing time is not limited to the end surface 33. In consideration of the unevenness of the peripheral portion, additional polishing may be performed for a certain time that is determined based on the changing point of the average load of the motor 12. Further, in order to improve a surface roughness of the peripheral portion, finish polishing may be performed using a polishing tape having abrasive particles of a different grain size. Although the polishing tape 21 having the abrasive particles fixed to the polishing surface thereof is used in this embodiment, a nonwoven fabric may be used to form a polishing surface. In this case, polishing slurry is supplied onto the polishing surface or the substrate.

An approach to detecting the polishing end point is not limited to detecting the changing point of the average load of the motor. For example, the polishing end point can be detected by monitoring a surface temperature of the semiconductor substrate 13 during polishing. Generally, during polishing, the surface temperature of the semiconductor substrate 13 changes in the same manner as the average load of the motor 12. Therefore, the polishing end point can be determined based on the surface temperature of the semiconductor substrate 13 measured by an infrared radiation thermometer or the like. Especially, in a case where a combination of a chemical liquid and the polishing tape is used, a stable state and an abnormal state of a removal rate can be detected from the change in the surface temperature of the semiconductor substrate 13.

Figure 5:
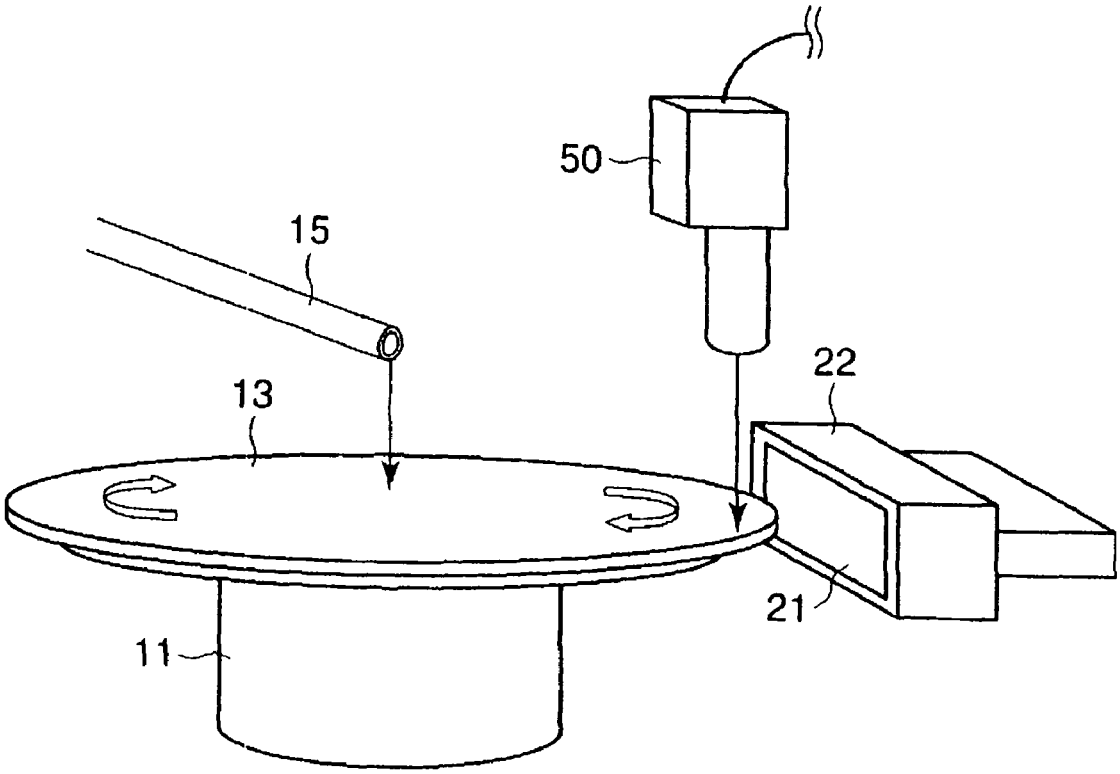
FIG. 5 is a schematic view showing a modified example of the substrate processing apparatus using a temperature sensor according to the first embodiment of the present invention.

FIG. 5 shows a specific structure for detecting the polishing end point based on the surface temperature of the semiconductor substrate. As shown in FIG. 5, a temperature sensor 50 is provided above the peripheral portion of the semiconductor substrate 13 for measuring a surface temperature of the semiconductor substrate 13 that is being polished. In order to quickly detect an increase in the surface temperature due to polishing, it is preferable that a position of the temperature sensor 50 is slightly shifted in a rotating direction of the semiconductor substrate 13 from a contact portion between the semiconductor substrate 13 and the polishing tape 21.

Because friction between the polishing tape 21 of the polishing head 22 and the peripheral portion of the semiconductor substrate 13 changes at the polishing end point, the surface temperature of the peripheral portion also changes. Specifically, since the friction becomes high at the polishing end point, the surface temperature increases. Therefore, the polishing end point can be determined by detecting the increase of the surface temperature to a predetermined value.

Second Embodiment

The second embodiment of the present invention is a method of detecting an anomaly in polishing from the load signal of the motor and of adjusting the polishing end point. As with the first embodiment, the substrate processing apparatus illustrated in FIG. 1 is used in this embodiment.

Figure 6A:
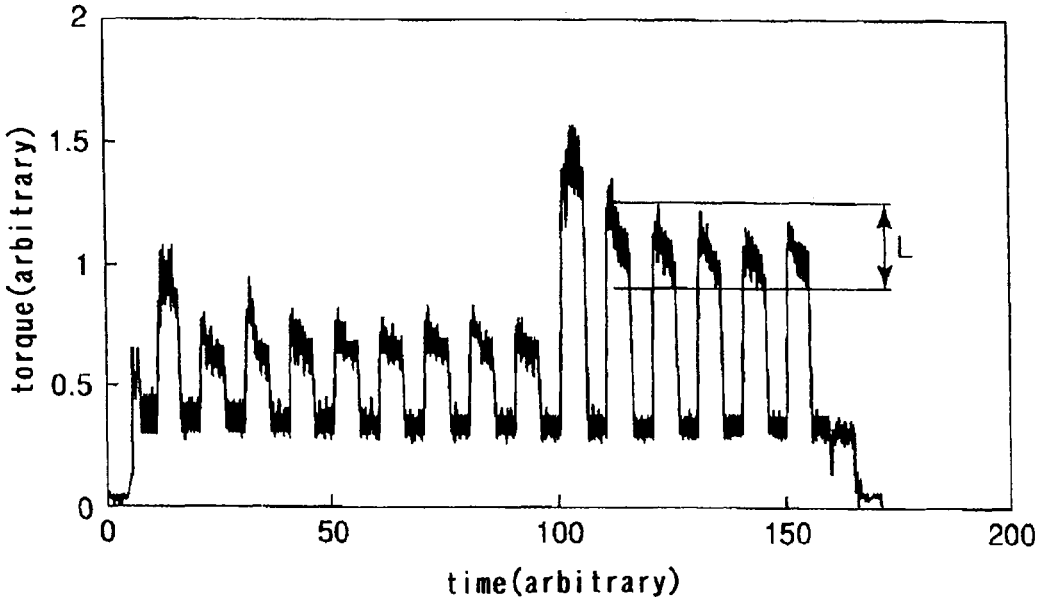
FIGS. 6A and 6B are graphs each showing a manner in which the load signal of the motor changes during polishing in a second embodiment of the present invention, FIG. 6A showing a normal state, and FIG. 6B showing an abnormal state.
Figure 6B:
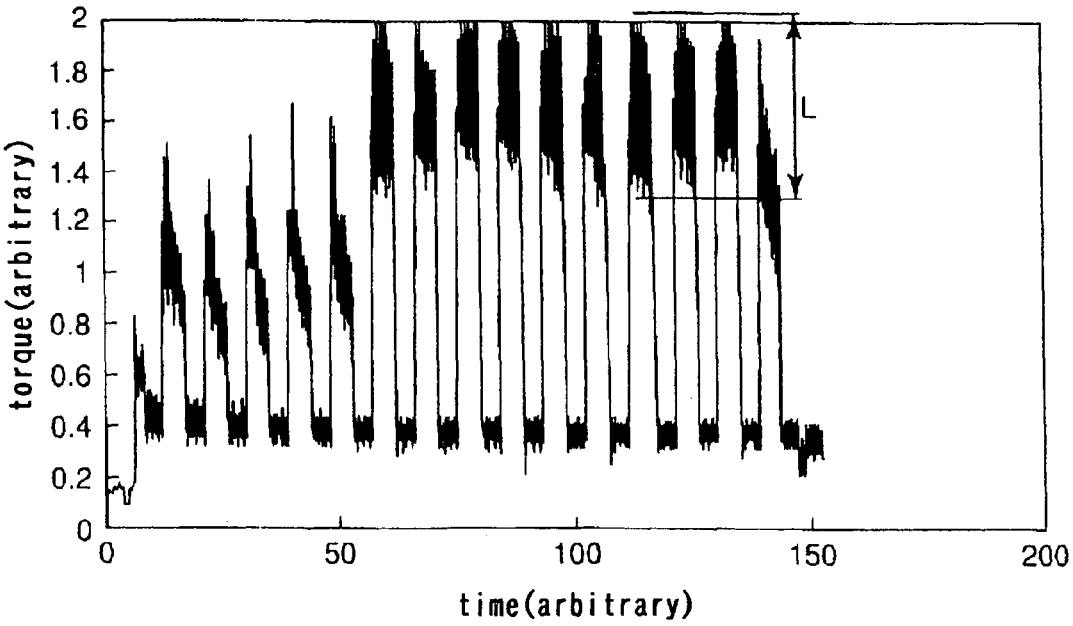

FIG. 6A is a graph showing a manner in which the load signal of the motor 12 changes when the end surface 33 of the semiconductor substrate 13 is being polished. As indicated by a symbol L in FIG. 6A, an oscillation (a load fluctuation) with respect to the average load occurs due to the rotation of the rotating stage 11. Ideally, a stable load signal should preferably be measured. However, in a practical apparatus, when the semiconductor substrate 13 is placed onto the rotating stage 11, the center of the semiconductor substrate 13 may deviate from the center of the rotating stage 11. Possible causes of such deviation in a range of 10 to 100 μm include an error in repetitive operation of the transfer system. Deviation over 100 μm can be caused by an abnormal operation of the transfer system or an anomaly in the substrate holding mechanism. In this case, as shown in FIG. 6B, the load fluctuation of the motor 12 becomes greater than that shown in FIG. 6A. That is, as the deviation of the substrate 13 from the center of the rotating stage 11 becomes greater, the load fluctuation magnitude L becomes larger.

The deviation from the center of the rotating stage 11 causes instability in contact between the polishing tape 21 and the semiconductor substrate 13, and also causes instability in pressure applied to the semiconductor substrate 13. As a result, a finished state of the peripheral portion is uneven, and, in the worst case, the semiconductor substrate 13 may crack during polishing. Therefore, it is necessary to grasp a degree of the anomaly in polishing so as to take appropriate measures. In this embodiment, in order to detect the anomaly, the arithmetic unit 14 calculates the load fluctuation magnitude with respect to the average load during polishing.

Specifically, a normal range of a magnitude of the deviation from the center of the rotating stage 11 is firstly determined. Next, a relationship between the magnitude of the deviation in the normal range, the average load of the motor 12, the load fluctuation magnitude, and the finished state of the peripheral portion is studied. Then, an allowable value (i.e., a threshold) of the load fluctuation magnitude is determined based on the above relationship. When the load fluctuation magnitude exceeds the allowable value during polishing, it can be determined that an anomaly occurred in polishing.

Even if the load fluctuation magnitude is below the threshold, an eccentric rotation may cause an uneven finish of the peripheral portion. In the second embodiment, additional polishing is incorporated into the polishing sequence of the first embodiment. Specifically, a polishing end point is firstly determined based on the great changing point of the average load, and then an additional polishing time is calculated based on the load fluctuation magnitude. In this case, the additional polishing time varies in proportion to the load fluctuation magnitude that is observed from the change in the electric current indicating the load, i.e., torque, of the motor. With this method, the uneven finish of the peripheral portion can be prevented from occurring due to a lack of polishing.

Figure 7:
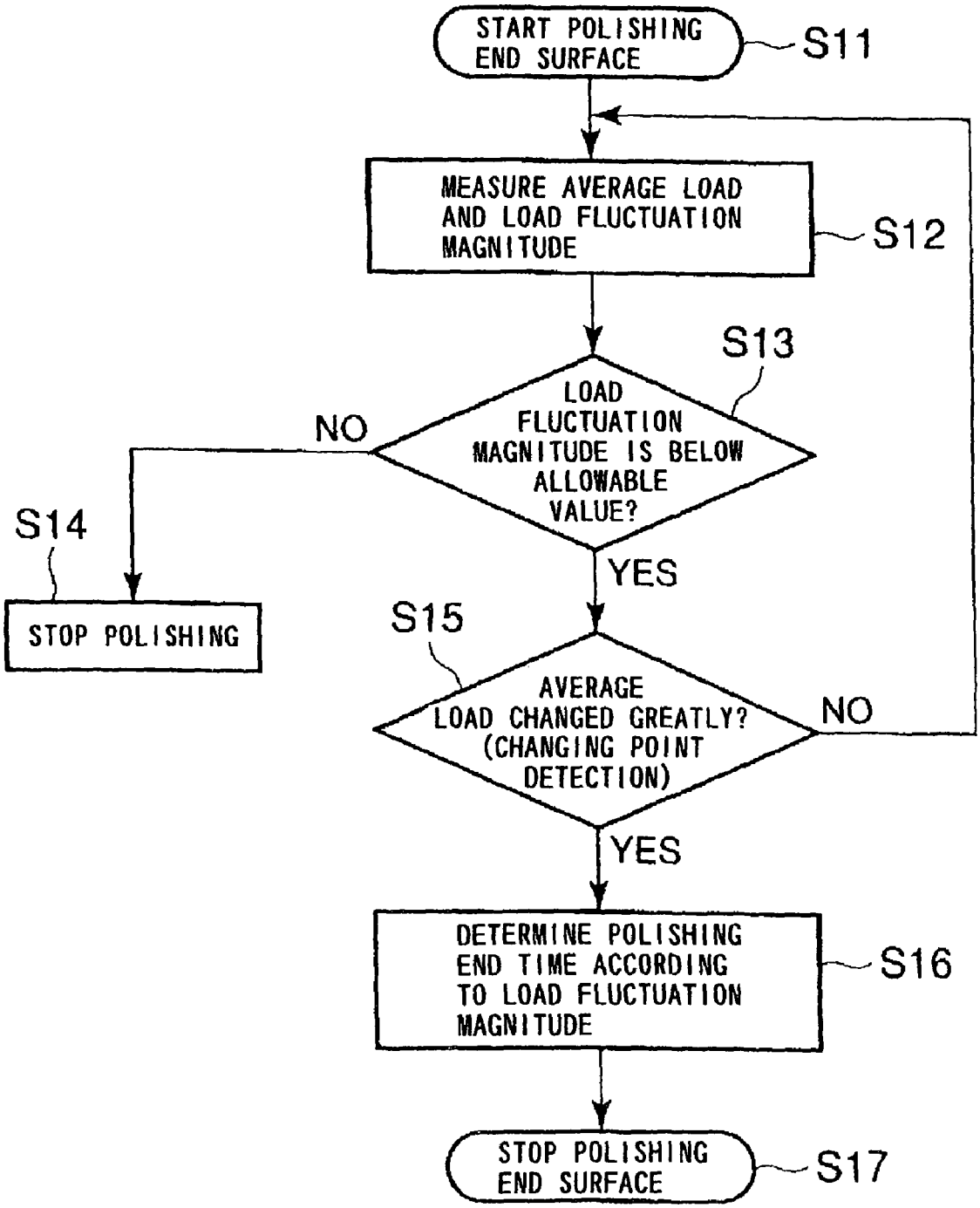
FIG. 7 is a flowchart illustrating a polishing operation according to the second embodiment of the present invention.

FIG. 7 shows a flowchart illustrating the polishing operation according to the second embodiment of the present invention.

First, the rotating stage 11 attracts the semiconductor substrate 13 and is rotated by the motor 12 at a constant speed. Then, the polishing head 22 is moved toward the semiconductor substrate 13 to bring the polishing tape 21 into contact with the end surface 33 of the peripheral portion of the semiconductor substrate 13. The polishing tape 21 is pressed against the end surface 33 at a certain pressure to thereby start polishing the end surface 33 (STEP 11). As with the first embodiment, the polishing tape 21 is repetitively brought into and out of contact with the semiconductor substrate 13 at intervals of several seconds. When in contact, the polishing tape 21 polishes the semiconductor substrate 13, and when out of contact, the polishing tape 21 is moved vertically. When the semiconductor substrate 13 is being polished, the load signal of the motor 12 is monitored so that the average load is measured. Further, during polishing, the amplitude of the load signal (i.e., the load fluctuation magnitude) with respect to the average load is measured (STEP 12).

Next, the arithmetic unit 14 judges whether or not the load fluctuation magnitude is below the allowable value (STEP 13). If the load fluctuation magnitude exceeds the allowable value, then it is judged that the polishing anomaly occurred and polishing is stopped (STEP 14). If the load fluctuation magnitude is below the allowable value, the arithmetic unit 14 judges whether or not the average load changed greatly (STEP 15). If the average load changes little, the polishing operation is continued.

If the average load exceeds the predetermined value, such a load changing point is selected as a temporary polishing end point. Then, the arithmetic unit 14 determines a polishing end time, i.e., an actual polishing end point, according to the load fluctuation magnitude that has been calculated in advance (STEP 16). Specifically, a point at which a predetermined time t has elapsed from the temporary polishing end point is set as the polishing end time. When the load fluctuation magnitude is small, the predetermined time t is set to be short. When the load fluctuation magnitude is large, the predetermined time t is set to be long. In this manner, the predetermined time varies in proportion to the load fluctuation magnitude. The polishing operation is continued until the polishing end time is reached, and polishing of the end surface 33 is stopped at the polishing end time (STEP 17).

In this manner, according to this embodiment, the anomaly in polishing can be detected by monitoring the load of the motor 12 during polishing of the peripheral portion of the semiconductor substrate and by measuring the load fluctuation magnitude. It is therefore possible to prevent an uneven finish of the peripheral portion and the substrate cracking due to deviation of the semiconductor substrate 13 from the center of the rotating stage 11.

In the second embodiment, the load of the motor 12 is monitored so that the average load per unit time and the load fluctuation magnitude are measured. The polishing end time is determined based on the load changing point and the load fluctuation magnitude. The load changing point is defined as a point at which the average load exceeds a predetermined value. With this method, polishing can be performed in a manner that gives consideration to nonuniform film thickness, irregularities with different heights, unevenly distributed abrasive particles, and nonuniform structure of a polishing cloth. Therefore, it is possible to prevent the unwanted film and the irregularities from remaining on the substrate due to a lack of polishing, and also to prevent a profile of the peripheral portion from changing due to excessive polishing. Accordingly, a desired profile of the peripheral portion of the substrate can be realized.

MODIFIED EXAMPLE

The present invention is not limited to the above-mentioned embodiments. Specifically, although the polishing tape having the abrasive particles fixed to the polishing surface thereof is used in the above embodiments, a nonwoven fabric may by used to form a polishing surface. In this case, instead of pure water, a polishing liquid, i.e., slurry, is supplied to the surface of the substrate. The polishing liquid contains a chemical liquid and free abrasive particles. The chemical liquid serves to weaken bonds between molecules of the substrate. The abrasive particles are semi-fixed to the surface of the nonwoven fabric, and the molecules of the substrate are scraped off by relative motion between the substrate and the nonwoven fabric. It is possible to add the chemical liquid to the polishing tape. It is also possible to use the polishing tape and the chemical liquid together. Although one polishing mechanism is used in the above embodiments, a plurality of polishing mechanisms can be provided along the peripheral portion of the substrate. In this case also, the polishing end point can be detected by monitoring the load of the motor that rotates the rotating stage.

In the first and second embodiments, the polishing tape is brought into sliding contact with the substrate to scrape off the contact portion with the abrasive particles, thereby polishing the peripheral portion. The polishing method using the polishing tape has the following advantages. Since the abrasive particles are fixed to the polishing tape, the abrasive particles are hardly scattered in the substrate processing apparatus. Further, the polishing tape can be easily replaced and no slurry remains in a pipe. Furthermore, the polishing tape with no chemical liquid requires little maintenance in terms of temperature, humidity, and its service life.

Generally, the polishing method using a polishing liquid (i.e., slurry) requires a large amount of the polishing liquid, which is scattered in the apparatus to seriously contaminate the substrate. Further, the polishing liquid may adhere to the substrate, thus imposing a large load on a subsequent cleaning process. For such reasons, the present invention is preferably applied to the polishing method and apparatus using the polishing tape.

The substrate processing method and apparatus according to the above-mentioned embodiments can be used to remove needle projections formed on a peripheral portion of a substrate. In a RIE (Reactive Ion Etching) process of forming trenches for a trench capacitor on a surface of a Si wafer, by-products produced during etching may be attached to the peripheral portion of the Si wafer. Such by-products act as masks for etching, thus forming needle projections on the peripheral portion of the Si wafer. The heights of the needle projections vary depending on the positions of the needle projections and are as large as about 10 μm at their maximum height. The needle projections are broken in transferring or processing the Si wafer, thus producing particles. Since such particles lead to a lower yield, it is necessary to remove the needle projections formed on the peripheral portion.

The substrate processing method and apparatus according to the embodiments can remove such needle projections from the peripheral portion of the substrate, as can be seen in FIG. 2B. In this manner, the substrate processing method and apparatus can be utilized not only in removing an unwanted film, but also in planarizing such an uneven surface. In both cases, a desired profile of the peripheral portion can be obtained, and the polishing anomaly can be detected. According to the embodiments of the present invention, nicks, notches, irregularities, and films can be sufficiently removed from the peripheral portion of the substrate.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A substrate processing method for polishing a peripheral portion of a substrate, said method comprising:

rotating the substrate by a motor;

polishing a first surface of the peripheral portion of the substrate by pressing a polishing surface of a polishing mechanism against the first surface while rotating the substrate;

determining a polishing end point of the first surface during said polishing by monitoring a polished state of the first surface;

stopping said polishing according to said determining of the polishing end point;

determining a polishing time spent for said polishing;

determining a polishing time for a second surface of the peripheral portion based on the polishing time of the first surface; and polishing the second surface for the determined polishing time with the polishing surface inclined along the second surface.

2. The substrate processing method according to claim 1, wherein:

the first surface comprises an end surface substantially perpendicular to a front surface of the substrate; and the second surface comprises an upper sloping surface and a lower sloping surface which are adjacent to the first surface.

3. The substrate processing method according to claim 1, wherein said determining of the polishing end point comprises:

monitoring a load of the motor;

measuring an average load per unit time of the motor; and detecting a load changing point at which the average load exceeds a predetermined value.

4. The substrate processing method according to claim 3, wherein a point at which a predetermined time has elapsed from the load changing point is set as a polishing end time of the first surface.

5. The substrate processing method according to claim 1, wherein said determining the polishing end point comprises:

measuring a surface temperature of the substrate; and detecting an increase of the surface temperature to a predetermined value.

6. The substrate processing method according to claim 1, wherein the polishing mechanism comprises a polishing tape having the polishing surface, and a polishing head for pressing said polishing tape against the peripheral portion of the substrate.

7. A substrate processing method for polishing a peripheral portion of a substrate, said method comprising:

rotating the substrate by a motor;

polishing the peripheral portion of the substrate by pressing a polishing surface of a polishing mechanism against the peripheral portion while rotating the substrate;

monitoring a load of the motor during said polishing;

measuring an average load per unit time of the motor during said polishing and a load fluctuation magnitude with respect to the average load;

comparing the load fluctuation magnitude with a threshold value; and determining an occurrence of an anomaly in said polishing when the load fluctuation magnitude exceeds the threshold value.

8. The substrate processing method according to claim 7, wherein said polishing is stopped when the occurrence of the anomaly in said polishing is determined.

9. The substrate processing method according to claim 7, wherein the polishing mechanism comprises a polishing tape having the polishing surface and a polishing head for pressing said polishing tape against the peripheral portion of the substrate.

10. The substrate processing method according to claim 7, wherein said monitoring the load of the motor is performed continuously or intermittently.

11. A substrate processing method for polishing a peripheral portion of a substrate, said method comprising:

rotating the substrate by a motor;

polishing the peripheral portion of the substrate by pressing a polishing surface of a polishing mechanism against the peripheral portion while rotating the substrate;

monitoring a load of the motor during said polishing;

measuring an average load per unit time of the motor during said polishing and a load fluctuation magnitude with respect to the average load;

detecting a load changing point at which the average load exceeds a predetermined value; and determining a polishing end time of the peripheral portion based on the load changing point and the load fluctuation magnitude.

12. The substrate processing method according to claim 11, wherein:

a point at which a predetermined time has elapsed from the load changing point is set as the polishing end time; and the predetermined time varies in proportion to the load fluctuation magnitude.

13. The substrate processing method according to claim 11, wherein the polishing mechanism comprises a polishing tape having the polishing surface, and a polishing head for pressing said polishing tape against the peripheral portion of the substrate.

14. The substrate processing method according to claim 11, wherein said monitoring the load of the motor is performed continuously or intermittently.

* * * * *